United States Patent [19]

Ryer, II et al.

[11] Patent Number: 4,961,546

[45] Date of Patent: Oct. 9, 1990

[54] STRAND TENSION COMPENSATOR

[75] Inventors: Richard N. Ryer, II, Easley; Fetta, Jeffrey E., Central, both of S.C.

[73] Assignee: Platt Saco Lowell Corporation, Greenville, S.C.

[21] Appl. No.: 417,956

[22] Filed: Sep. 29, 1989

[51] Int. Cl.[5] ..... B65H 59/26

[52] U.S. Cl. ..... 242/154

[58] Field of Search ..... 242/154, 153, 147 R, 242/45, 18 R, 18 DD

[56] References Cited

U.S. PATENT DOCUMENTS

| | | | |
|---|---|---|---|
| 3,300,161 | 1/1967 | Hermanns | 242/154 |
| 4,133,493 | 1/1979 | Schewe | 242/154 |
| 4,312,482 | 1/1982 | Schewe | 242/154 |
| 4,854,509 | 8/1989 | Boller et al. | 242/154 X |
| 4,854,513 | 8/1989 | Boller et al. | 242/154 X |

*Primary Examiner*—Stanley N. Gilreath

*Attorney, Agent, or Firm*—Bailey & Hardaway

[57] ABSTRACT

A tension compensator for a textile strand includes an electronic closed loop arrangement for use intermediate means delivering the strand which may be at constant speed and a take up or other consuming apparatus such as a package onto which the strand is being wound at a varying rate.

7 Claims, 3 Drawing Sheets

STRAND TENSION COMPENSATOR

BACKGROUND OF THE INVENTION

This invention relates to strand tension compensation and more particularly to maintaining approximately constant tension in a strand being delivered at an incessant rate and wound upon a package at a varying rate. As used herein, the term "strand" is intended to be construed in its broadest sense and includes any elongated material which may be wound according to the apparatus of the invention. A tension compensator or slackness buffer is provided capable of operating reliably at slow to relatively high speeds.

When a strand is delivered at a constant speed from a stationary source to a conical package, the takeup rate of the package will vary depending upon the point on the package to which the strand is being wound due to the disparity caused by the transverse whether the carrier for the package is straight or conical. This disparity is greater where the carrier is conical because the diameter of the package is smaller at one end than the other, but its angular velocity is constant. When the takeup rate is less than that of the delivery, e.g. when the strand is being wound on the small end of the conical package, excess strand is produced. Concomitant with the production of excess strand are changes in strand tension, which negatively affects strand quality and package formation. Therefore, it has long been considered essential in the textile industry to provide intermediate means of temporarily storing and subsequently releasing excess strand.

Various devices have been developed to attempt to provide this "slackness buffing" action. Most of these devices have employed a spring arrangement whereby a strand engaging member, e.g. a pegged disk or an arm, is biased to store strand when tension is low and release it when tension is high. Devices of this type are shown in U.S. Pat. Nos. 4,133,493, 4,312,482 and 4,605,181. While these mechanisms have proved successful at slow strand delivery speeds, they become inoperative when the otherwise higher speeds are attempted. This is because, at these higher speeds, the mechanical tensioner is operating near its natural frequency which causes catastrophic oscillations. At still higher speeds, the reaction time of the mechanism is inadequate. Therefore, production is impossible at the higher speeds.

Other devices, such as the one shown in U.S. Pat. No. 3,797,775, have attempted to maintain constant tension using a spinning capstan arrangement. Such devices operate by monitoring strand tension and slowing the capstan spin when the tension falls outside of predetermined limits. However, these arrangements have proved unreliable in practice.

Thus, while the above devices do function as slackness buffers to some degree, no apparatus has ever been developed to accomplish this goal reliably up to high delivery speeds.

Accordingly it is an object of this invention to provide an improved strand slackness buffing apparatus capable of operating from low to relatively high speeds.

It is a further object of this invention to provide a strand slackness buffing apparatus using a digital closed loop arrangement for control.

SUMMARY OF THE INVENTION

These as well as other objects are accomplished by an apparatus comprising an electric motor, a member attached to the motor for increasing or varying the distance in which the strand must travel between the strand delivery means and the package onto which the strand is being wound, a sensor monitoring the position of the member or, alternatively, the tension in the strand, and electronic means comprising a summing junction producing an error signal and further comprising electronic controller means to process the error signal to drive the motor.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

In accordance with this invention, it has been found that a digital closed loop system can be used to store and release excess yarn being delivered at an incessant rate and wound onto a package at a varying rate at higher speeds than have been heretofore attained.

Figure 1:
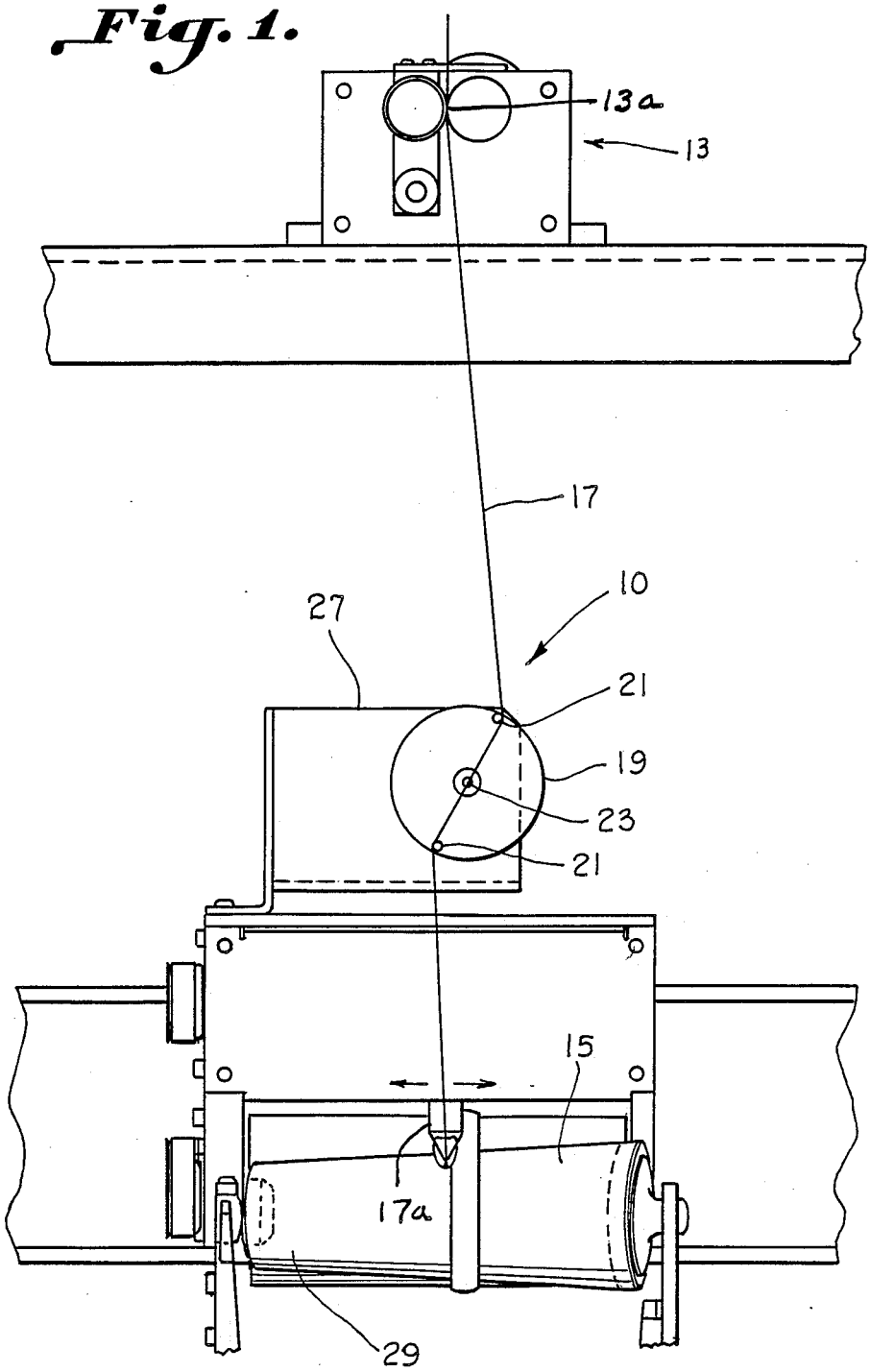
FIG. 1 is a front elevational view illustrating the apparatus constructed in accordance with the invention intermediate a strand delivery source and a conical package onto which the strand is being wound.
Figure 2:
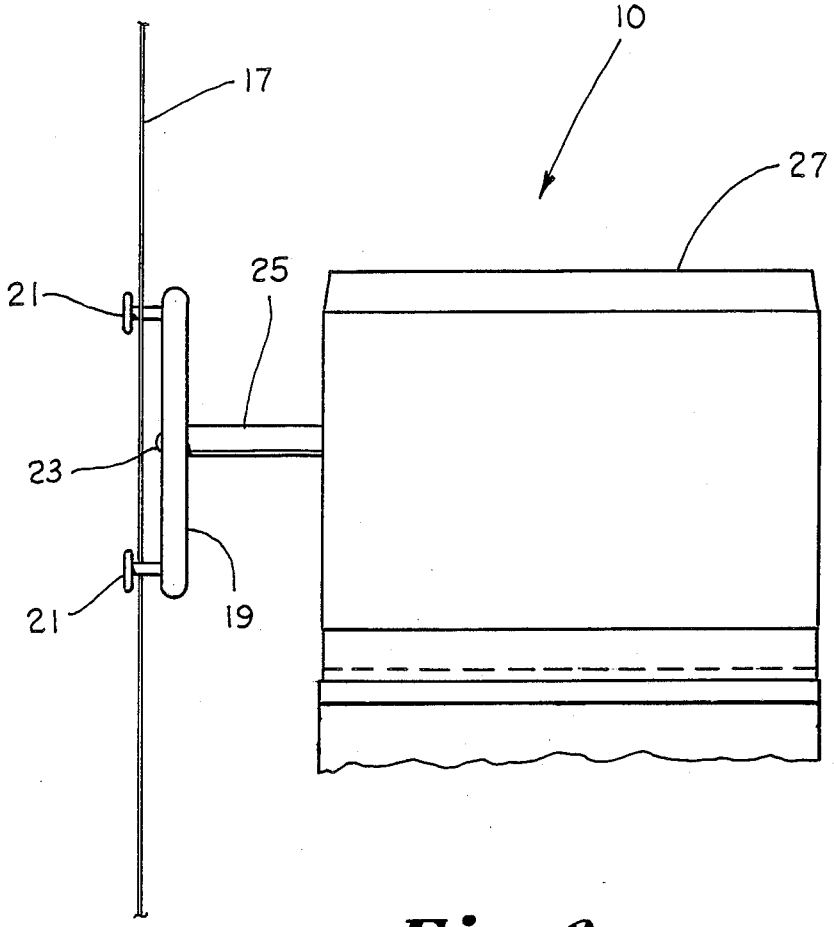
FIG. 2 is a side elevational view illustrating the apparatus constructed in accordance with the invention.

FIG. 1 illustrates an embodiment of the invention as it appears in operation with a conical or cheese take-up. The apparatus comprises a tension compensator or slackness buffer broadly designated at 10. The buffer 10 is positioned intermediate a constant speed delivery source 13 having a delivery point **13*a* and a cone 15 onto which a strand 17 is being wound at a traversing take up point forming a package. The disk 19 of the buffer 10 has thereupon a pair of spaced pegs 21 for engaging the strand 17. The disk 19 is attached at 23 to a shaft 25 (FIG. 2) of a rotational electric motor 27 or other suitable electrically operated servo motor, linear actuator or other actuator. The disk 19** may be biased in either direction toward home position and is illustrated as biased in one clockwise direction by electrical circuitry comprising a digital closed loop system.

A condition of no excess in the strand 17 the disk tends not to rotate. When there is an excess of yarn, e.g. when the strand 17 is being fed onto small end 29 of package 15, a condition of lesser tension in the strand 17 exists. The disk 19 thereby rotates in its clockwise bias direction toward a predetermined home position to increase the path distance of the strand. Shortage of yarn, e.g. when the strand 17 is being fed on to the large end of the package 15 causes rotation opposite from the bias direction, thus paying the strand 17 out of the buffer 10. In this way, approximately constant tension is maintained. The function of the electrical circuitry is, therefore, similar to that of the spring in prior art devices. However, the present invention is not susceptible to the natural frequency oscillations or response times of mechanical springs. Therefore much higher strand delivery speeds are attainable. In fact, the invention is functional at speeds of 500 meters per minute or more, which is the maximum operating speed of the strand delivery and winding equipment currently available.

Figure 3:
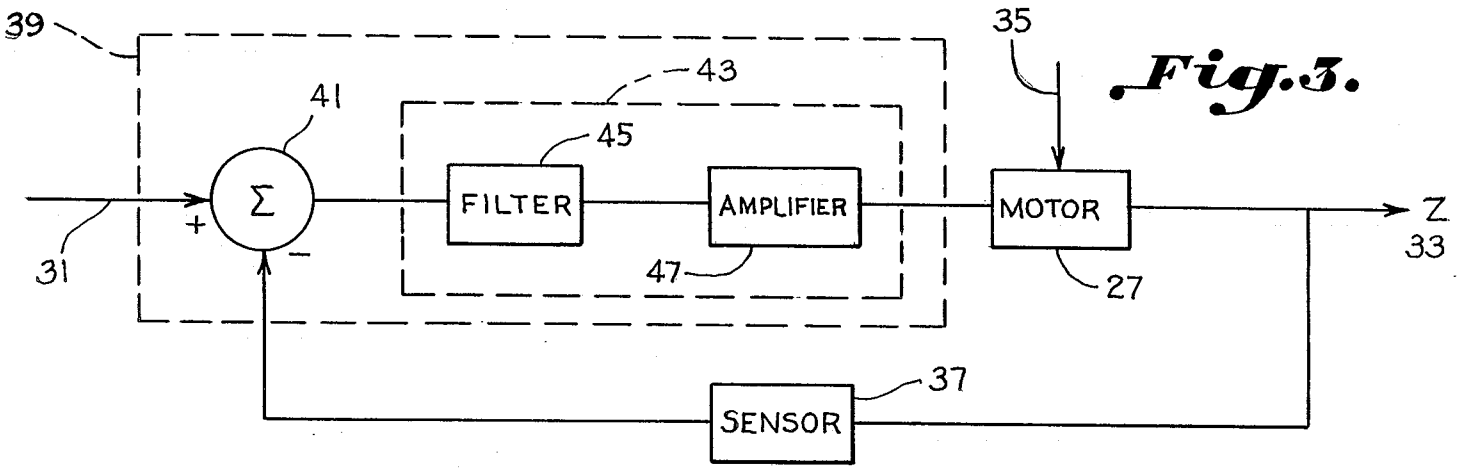
FIG. 3 is a block diagram illustrating the closed loop arrangement of the preferred embodiment of the invention.

The closed loop is shown in block diagram form in FIG. 3. An input at 31 represents the predetermined home position of the shaft 25. It should be noted that the home position can take a variety of locations depending upon the setting of the input voltage at 31 which represents the home position. This allows the user much greater versatility in the placement of the various machinery contributing to the strand winding process. Shown at 33 is the system output, which is the actual location of the shaft 25. The effect of the varying tension in the strand 17 is shown as a disturbance input 35 to the motor 27. A sensor 37, here chosen to be an optical quadrature encoder, mounted on the opposite end of the shaft 25, monitors the position of the shaft. Electronic means or computer 39 is provided to subtract the output of sensor 37 from input 31 at summing junction 41 and to process the resulting error signal utilizing controller means 43.

In this embodiment, controller means 43 further comprises a digital filter 45 and pulse width modulated amplifier 47. The controller means 43 function to provide motor 27 with a suitable driving current. Motor 27 is thereby driven until the actual shaft position and home position agree. The parameters of filter 45 can be changed to alter the characteristics of the system.

Some of the changes which could be made are:

1. The stiffness of the correction force;
2. The damping of oscillations and overall system stability; and
3. System response time.

Thus, slack is measured in a yarn and this information is transmitted to the computer. The computer commands the apparatus to take up slack in the yarn.

Figure 4:
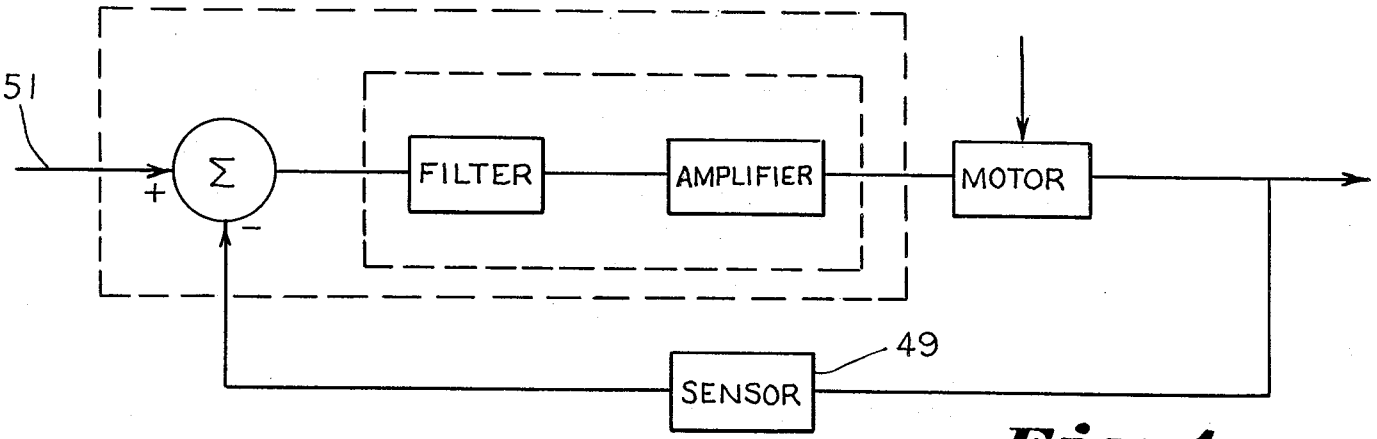
FIG. 4 is a diagram similar to FIG. 3 illustrating an alternative form of the invention.

In an alternative embodiment of the invention, the positional sensor 37 is replaced with a strand tension sensor 49, as shown in FIG. 4. The input at 51 represents the predetermined home position. The system will compensate for the tension in a similar way as position is compensated for in the embodiment of FIG. 3.

Thus, the computer controlled motor, which may preferably be a DC motor, acts instead of the mechanical spring of the prior art. First, the computer reads the position of the disk member or other support members for the pegs. Then, a calculation of an error signal is made based on the difference between home and actual position. The error signal is applied to the motor through the amplifier. Thus, the computer signal is applied in motor language. The distance, traveled by the yarn from its delivery point to the point at which it is taken up is adjusted so that all slackness is removed from the yarn as it is traversed along the cone. This is so even though the diameter progressively builds as the yarn is wound on the cone.

The path in which the strand must travel is varied between the delivery means and the package by passing the strand about a member that changes position. It is thus seen that the invention provides a novel strand slackness buffing apparatus using a digital closed loop arrangement for control. While embodiments of the invention have been described using specific terms, such description is for illustrative purposes only, and it is to be understood that changes and variations may be made without departing from the spirit or scope of the following claims.

What is claimed is:

1. A tension compensator for use intermediate means delivering a strand at an approximately constant speed and a package upon which said strand is wound at a varying rate along the length of the package comprising:

an electric actuator;

a member attached to said actuator for varying the distance in which said strand must travel between said delivery means and said package;

a sensor for monitoring the position of said member;

electronic means for comparing the actual position of said member with a predetermined home position and thereby generating an error signal; and said electronic means further comprising controller means receiving the error signal input and driving said actuator toward said home position;

whereby approximately constant tension in said strand is maintained.

2. The structure set forth in claim 1 wherein said actuator is a rotational motor having a shaft.

3. The structure set form in claim 2 wherein said motor is a direct current motor.

4. The structure set forth in claim 2 wherein said member attached to said motor shaft is a disk, said member further comprising a pair of pegs projecting outwardly from said disk for engaging said strand, said pegs and adjacent the edge of said disk and parallel to said shaft.

5. The structure set forth in claim 1 wherein said sensor is a digital sensor, and said controller means comprises, in series, a digital filter and pulse width modulated signal amplifier, whereby said filter processes said error signal and said amplifier provides said motor with a usable driving signal.

6. The structure set forth in claim 5 wherein said sensor is an optical quadrature encoder.

7. The method of delivering a strand at an approximately constant speed between a delivery means and a package upon which said strand is wound at a varying rate along the length of the package comprising the steps of:

providing an electric actuator;

varying the distance in which said strand must travel between said delivery means and said package by passing the strand about a member which changes position connected to said electric actuator;

sensing the position of said member;

comparing the actual position of said member with a predetermined home position and thereby generating an error signal; and receiving the error signal input and driving said actuator toward said home position;

whereby approximately constant tension in said strand is maintained.

* * * * *